US006522232B2

(12) United States Patent
Paul et al.

(10) Patent No.: US 6,522,232 B2
(45) Date of Patent: Feb. 18, 2003

(54) IGNITION APPARATUS HAVING REDUCED ELECTRIC FIELD HV TERMINAL ARRANGEMENT

(75) Inventors: Mark Albert Paul, Fishers, IN (US); Albert Anthony Skinner, Anderson, IN (US); Harry Oliver Levers, Jr., Muncie, IN (US)

(73) Assignee: Delphi Technologies, Inc., Troy, MI (US)

( * ) Notice: Subject to any disclaimer, the term of this patent is extended or adjusted under 35 U.S.C. 154(b) by 51 days.

(21) Appl. No.: 09/971,234

(22) Filed: Jul. 2, 2001

(65) Prior Publication Data

US 2002/0158740 A1 Oct. 31, 2002

Related U.S. Application Data

(60) Provisional application No. 60/286,758, filed on Apr. 26, 2001.

(51) Int. Cl.[7] ..... H01F 27/02; H01F 27/04

(52) U.S. Cl. ..... 336/96; 336/92; 336/90; 336/107; 29/602.1

(58) Field of Search ..... 123/364, 620, 123/631, 643; 336/96, 107, 90, 92; 324/399; 29/602.1

(56) References Cited

U.S. PATENT DOCUMENTS 5,590,637 A * 1/1997 Motodate ..... 123/634
5,714,922 A 2/1998 Suzuki et al. ..... 336/107
6,208,231 B1 3/2001 Oosuka et al. ..... 336/107

OTHER PUBLICATIONS

Moga et al, "Ignition Apparatus Having Feature for Shielding the HV Terminal," USSN 09/932,267 filed Aug. 17, 2001.

* cited by examiner

*Primary Examiner*—Anh Mai
(74) *Attorney, Agent, or Firm*—Margaret A. Dobrowitsky

(57) ABSTRACT

An ignition apparatus includes a high voltage (HV) terminal formed of stamped sheet metal attached to a secondary winding spool, and to which a high voltage end of the secondary winding is soldered. The ignition apparatus further includes an electrically conductive cup formed of stamped aluminum or brass that is disposed in a case and is configured to receive the high voltage terminal when the secondary winding spool is inserted in the case. The high voltage terminal has a spring tab or the like that is biased radially outwardly into engagement with an inner annular surface of the cup. A bottom outer surface of the cup is arranged to be engaged by a high voltage spring or the like for making the connection to the spark plug. The cup is substantially free of burrs, sharp edges, and the like, and therefore reduces localized occurrences of high electric field concentrations, which could otherwise lead to insulating material, and thus ignition coil, failure.

16 Claims, 3 Drawing Sheets

IGNITION APPARATUS HAVING REDUCED ELECTRIC FIELD HV TERMINAL ARRANGEMENT

RELATED APPLICATIONS

This application claims the benefit of U.S. Provisional Application No. 60/286,758, filed Apr. 26, 2001, hereby incorporated by reference.

BACKGROUND OF THE INVENTION

1. Technical Field

The present invention relates generally to ignition coils for developing a spark firing voltage that is applied to one or more spark plugs of an internal combustion engine.

2. Discussion of the Background Art

Ignition coils are known for use in connection with an internal combustion engine such as an automobile engine, and which include a primary winding, a secondary winding, and a magnetic circuit. The magnetic circuit conventionally may comprise a cylindrical-shaped, central core extending along an axis, located radially inwardly of the primary and secondary windings and magnetically coupled thereto. The components are contained in a case formed of electrical insulating material, with an outer core or shield located outside of the case. One end of the secondary winding is conventionally configured to produce a relatively high voltage when a primary current through the primary winding is interrupted. In a common configuration, insulating resin or the like is introduced into the gap between the secondary winding and the case for insulating purposes. The high voltage end is coupled to a spark plug, as known, that is arranged to generate a discharge spark responsive to the high voltage. It is further known to provide relatively slender ignition coil configuration that is adapted for mounting directly above the spark plug—commonly referred to as a "pencil" coil.

One problem in the design of ignition coils, particularly pencil coils, involves a relatively high electrical field concentration at a location where the high voltage end of the secondary winding is terminated to a high voltage terminal attached to a secondary winding spool. The relatively high electrical field concentration is magnified by any burr, sharp edge, or solder icicle that may be formed on the high voltage terminal. The high electrical field may also be magnified by a poor position of the high voltage terminal. That is, the terminal may be bent over during manufacture, and may be closer to the case than is desired. This means that there is less insulating resin between the terminal and the case. As a consequence, the increased electrical field concentration, over time, may result in an electrical tree or dendrite forming off of the high voltage terminal propagating through the insulating resin. After the dendrite grows far enough, for example toward ground potential (i.e., through the resin and case to the shield), the high voltage secondary winding will short to ground and the ignition coil will fail.

U.S. Pat. No. 6,208,231 issued to Oosuka et al. entitled "STICK-TYPE IGNITION COIL HAVING IMPROVED STRUCTURE AGAINST CRACK OR DIELECTRIC DISCHARGE," discloses an ignition coil wherein a high voltage end of the secondary coil is electrically connected to a dummy coil, which is then electrically connected to a terminal plate. A high voltage connector configured for connection to a spark plug is then connected to the terminal plate. Oosuka et al. disclose that since the secondary coil and the terminal plate are electrically connected through not a single connection but rather through the dummy coil, the surface area of the electrically connected portion between the secondary coil and the terminal plate is enlarged so as to avoid the concentration of electrical field. However, Oosuka et al. still disclose that the high voltage end of the dummy coil is electrically connected to the terminal plate by fusing or soldering. Accordingly, it is believed that the same problems described above continue to exist in the design of Oosuka et al.

Accordingly, there is a need for an improved ignition apparatus that minimizes or eliminates one or more of the problems as set forth above.

SUMMARY OF THE INVENTION

An object of the present invention is to solve one or more of the problems as set forth above. An ignition apparatus according to the present invention overcomes shortcomings of conventional ignition apparatus by including an electrically conductive cup absent of sharp edges, burrs, or the like, which makes contact with a spring tab extending from the high voltage terminal. The cup also surrounds the high voltage terminal. Because the cup is at the same voltage potential as the high voltage terminal, there will not be an electric field concentration in and around the area of the high voltage terminal. Instead, the electric field concentration will be at a reduced level around the cup. In one embodiment, a 72% reduction in the electric field intensity can be obtained with the arrangement according to the invention. The reduction in electric field concentration reduces or eliminates formation of dendrites which, as described in the Background, may over time result in ignition coil failures. This reduces warranty returns, among other things. In addition, manufacturability is improved, since equipment to remove solder points, and to ensure the desired bend dimensions of the HV terminal can be eliminated.

An ignition apparatus according to the present invention comprises a central core having a main axis, and primary and secondary windings outwardly of the central core. The secondary winding is wound on a secondary winding spool having a high-voltage terminal. A high voltage end of the secondary winding is connected to the high voltage terminal. The apparatus further includes a case outwardly of the core, the spool and the primary and secondary windings. According to the invention, a cup formed of metal material engages the high voltage terminal on an inner surface thereof. The cup is configured to be contacted by a conductive connector that is itself suitable for connection to a spark plug. The cup surrounds the HV terminal, and, being free of sharp edges and the like, reduces electrical field concentrations.

In a preferred embodiment, the cup is formed of aluminum or brass sheet metal material, which is drawn and formed into a cup absent sharp edges, burrs, and other similar artifacts that would result in an increased electric field intensity.

A method of making a high voltage connection including the aforementioned conductive cup is also presented.

BRIEF DESCRIPTION OF THE DRAWINGS

The present invention will now be described by way of example, with reference to the accompanying drawings, in which.

DETAILED DESCRIPTION OF THE PREFERRED EMBODIMENTS

Figure 1:
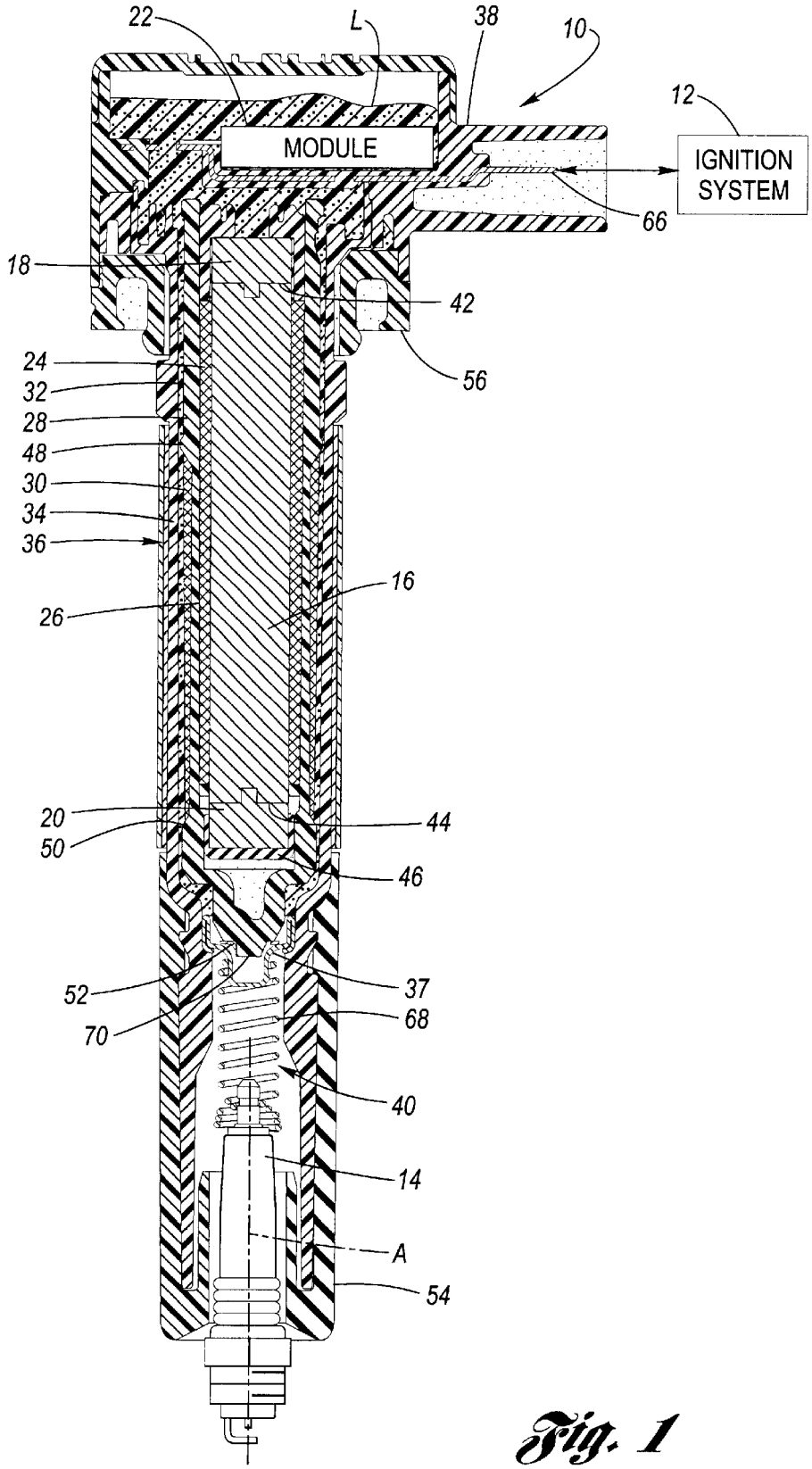
FIG. 1 is a simplified cross-sectional view of an ignition coil having a conductive cup high voltage terminal arrangement according to the present invention.

Referring now to the drawings wherein like reference numerals are used to identify identical components in the various views, FIG. 1 is a simplified, cross-section view of an ignition apparatus or coil 10 in accordance with the present invention. As is generally known, ignition apparatus 10 may be coupled to, for example, an ignition system 12, which contains primary energization circuitry for controlling the charging and discharging of ignition apparatus 10. Further, also as is well known, the relatively high voltage produced by ignition apparatus 10 is provided to a spark plug 14 (shown in phantom-line format) for producing a spark across a spark gap thereof, which may be employed to initiate combustion in a combustion chamber of an engine. Ignition system 12 and spark plug 14 perform conventional functions well known to those of ordinary skill in the art.

Ignition apparatus 10 is adapted for installation to a conventional internal combustion engine through a spark plug well onto a high-voltage terminal of spark plug 14, which may be retained by a threaded engagement with a spark plug opening into the above-described combustion cylinder. The engine may provide power for locomotion of a vehicle, as known.

FIG. 1 further shows a core 16, an optional first magnet 18, an optional second magnet 20, an electrical module 22, a primary winding 24, a first layer of encapsulant such as an epoxy potting material layer 26, a secondary winding spool 28, a secondary winding 30, a second layer 32 of epoxy potting material, a case 34, a shield 36, an electrically conductive cup 37, a low-voltage (LV) connector body 38, and a high-voltage (HV) connector assembly 40. Core 16 includes top end 42 and bottom end 44. FIG. 1 further shows a rubber buffer cup 46, annular portions 48, 50, high voltage terminal 52, boot 54, and seal member 56.

As described in the Background, a significant failure mode for conventional pencil coils results from a high electric field intensity at the high voltage terminal where the high voltage end of the secondary winding is terminated. Burrs, sharp edges, solder icicles, and the like magnify the electric field intensity. Over time, with such conventional arrangements, dendrites form, and grow through the insulating epoxy and case toward ground potential (e.g., toward the shield element). Once the insulating resin and/or case material has been compromised, the high voltage secondary winding can short to ground, thus failing the ignition coil.

Conductive cup 37 is made so as to not have sharp edges, burrs, or the like. The cup is in electrical contact with the high voltage terminal, and is therefore at the same electrical potential or voltage. Accordingly, the aforementioned electric field concentration is reduced relative to the prior art.

Figure 2:
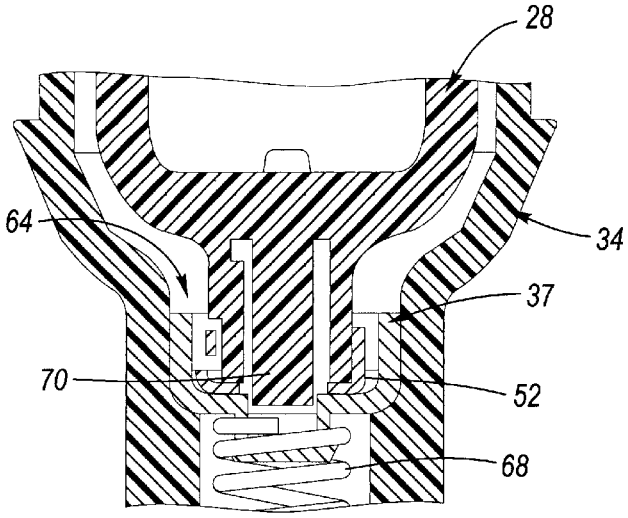
FIG. 2 is a simplified cross-sectional view of the encircled portion of FIG. 1 showing the cup in greater detail.
Figure 9:
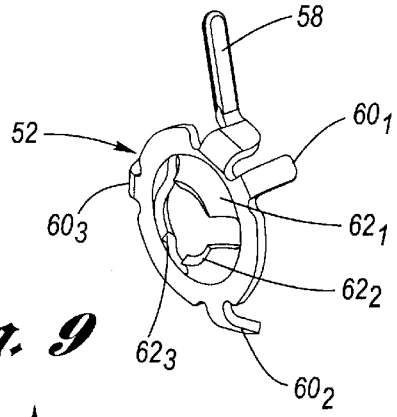
FIGS. 9–10 are top and bottom perspective views of a high voltage terminal shown in FIGS. 1–2.
Figure 10:
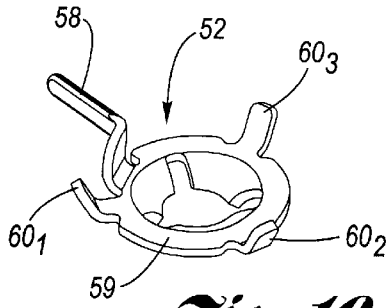
Figure 11:
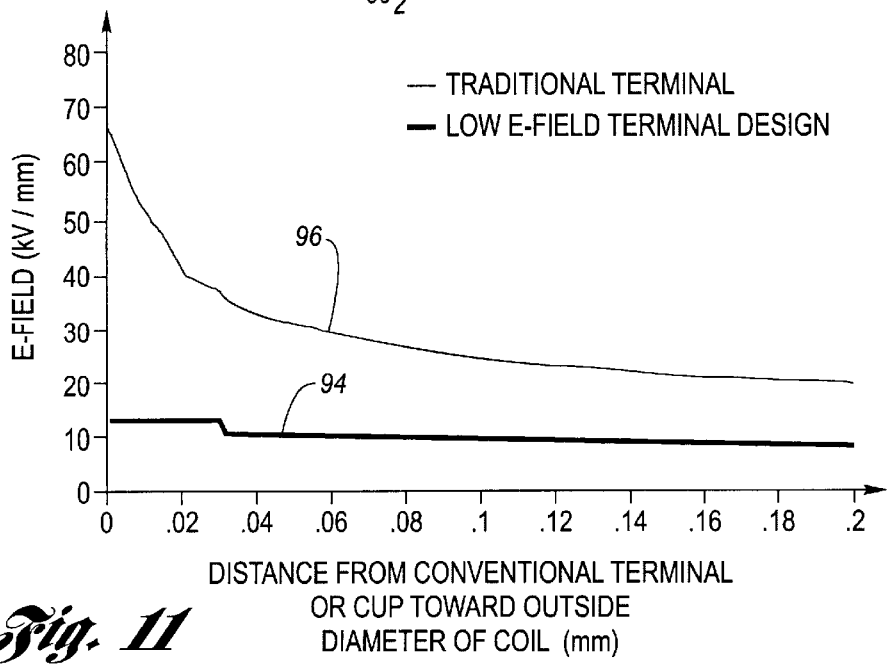
FIG. 11 is a simplified chart diagram showing the reduced electric field concentration according to the invention.

FIG. 2 shows the encircled region of FIG. 1 containing cup 37 in greater detail. The invention comprises a high voltage connection arrangement including high voltage (HV) conductive terminal 52, and cup 37. The HV terminal 52 may be of the conventional stamped sheet metal type that is attached to secondary spool 28 (e.g., insert molded or interference press-fit to spool), and to which a high voltage end of secondary winding 30 is terminated. FIGS. 9–10 are top and bottom views of HV terminal 52, which includes projection 58, a generally planar body portion 59, a plurality of electrical contact projections $\mathbf{60}_1$, $\mathbf{60}_2$, and $\mathbf{60}_3$ and a plurality of engagement projections $\mathbf{62}_1$, $\mathbf{62}_2$, and $\mathbf{62}_3$. HV terminal 52 includes projection 58 for providing a termination for the high voltage end of secondary winding 30. In a constructed embodiment, such termination is then soldered according to known methods. Projection 58 is then bent down (i.e., in a generally circumferential direction). High voltage terminal 52 also includes projections $\mathbf{60}_1$, $\mathbf{60}_2$, $\mathbf{60}_3$ which operate like a spring tab or similar mechanism that is resilient in nature and which is configured to move radially for engaging an inner surface of cup 37. Projections $\mathbf{62}_1$, $\mathbf{62}_2$, $\mathbf{62}_3$ are configured to be received on a lowermost projection on spool 28 in an interference fit arrangement.

Cup 37, generally, is configured in size and shape to be pressed or molded into the case 34 of ignition apparatus 10. As will be described in greater detail in connection with the first, second and third embodiments of FIGS. 3–8, cup 37 is manufactured in such a way so as to not have any sharp edges, burrs, or the like. These manufacturing approaches include but are not limited to machining and stamping, coupled with, for example, a vibratory finishing.

With continued reference to FIG. 2, when secondary spool 28 is inserted and pressed longitudinally downwardly into case 34, terminal 52 will go down into an interior portion of cup 37. Terminal 52 and cup 37 will be in positive electrical contact due to the above-mentioned spring tab projections $\mathbf{60}_1$, $\mathbf{60}_2$, $\mathbf{60}_3$, which effectively results in an interference fit. Because the cup 37 is at substantially the same voltage potential as high voltage terminal 52, and cup 37 surrounds terminal 52, there will be a substantially reduced or eliminated electric field concentration at terminal 52. A relatively small electric field concentration will exist near the edge of cup 37. The foregoing approach results in manufacturing advantages, cost advantages, as well as quality improvements.

As to manufacturing advantages, the approach shown in FIG. 2 results in an ignition apparatus design that is robust to the soldering process. In particular, solder tips and sharp edges that are present at the point where the secondary winding is terminated, and which arise due to conventional manufacturing processes can now be tolerated. In addition, the design of an ignition apparatus according to the invention will also be robust as to the bend position of terminal 52, so that the position of terminal 52 will now not have to be as controlled. In conventional arrangements, if high voltage terminal 52 (particularly projection 58) were not bent over far enough, the radially outermost portions thereof would be closer to case 34, and would result in a higher electric field. As to cost advantages, an ignition apparatus according to the invention is less expensive to manufacture since certain manufacturing equipment can be eliminated, such as (i) that required to eliminate sharp solder points, (ii) that needed to measure the HV terminal bend position. Finally, in an internal combustion engine environment, the reduced electric field will result in lower ignition apparatus failures, and accordingly a lower warranty return rate. These improvements result by the substantial reduction or elimination of case punch-through failures (i.e., dendrite growth through insulating resin material, through case material, to ground potential, namely, the outer core or shield). The reduced electric field concentration will also extend the service life of the ignition apparatus.

Figure 3:
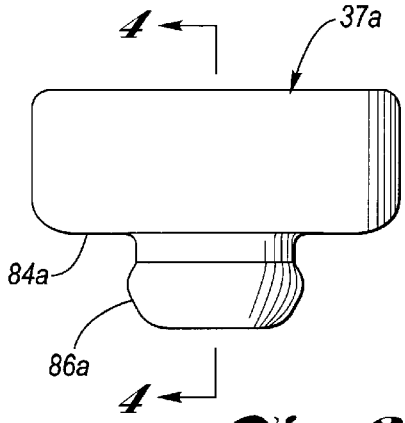
FIG. 3 is a simplified front view of a first embodiment of the cup of FIG. 2.
Figure 4:
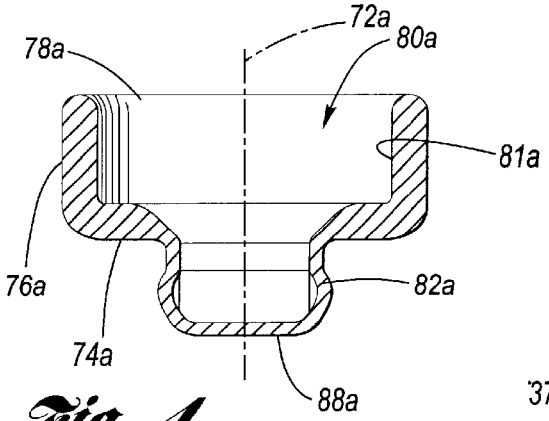
FIG. 4 is a simplified cross-sectional view of the first embodiment taken substantially along lines 4—4 in FIG. 3.

FIGS. 3–4 show a first embodiment of a conductive cup according to the invention, designated cup 37*a*. Cup 37*a* has a longitudinal axis 72*a* associated therewith. Cup 37*a* further includes a base 74*a*, and a first, generally annular side wall 76*a* extending therefrom in a first axial direction to define an opening 78*a* leading to an interior 80*a*. Interior 80*a* is configured to receive a corresponding feature formed on a lower longitudinal end of secondary winding spool 28 that is located near the high voltage terminal 52. As shown in FIG. 2, the corresponding feature comprises a spool gate 70. Interior 80*a* is defined, in-part, by an inner, generally annular surface 81*a*.

Cup 37*a* further includes a second annular side wall 82*a* extending from base 74*a* in a second axial direction opposite the first axial direction.

As shown particularly in FIG. 3, cup 37*a* includes a surface 84*a*, which is an outer surface of base 74*a*, and another surface 86*a*, which is an outer surface of second annular wall 82*a*. Surfaces 84*a* and 86*a* form an engagement arrangement for high voltage spring 68 suitable for connection to spark plug 14.

As further shown in FIG. 4, cup 37*a* includes a closed end 88*a* located opposite opening 78*a*. First annular side wall 76*a* has a first diameter while second annular side wall 82*a* has a second diameter that is less than the first diameter. The first diameter of side wall 76*a* is configured to provide a press-fit into the corresponding region of case 34.

In a constructed embodiment, cup 37*a* is preferably formed according to a machining process (e.g., using a screw machine), and may comprise aluminum, brass, or other suitably electrically conductive material. After machining, cup 37*a* may be subjected to vibratory finishing, well known to those of ordinary skill in the art, in order to remove any remaining sharp edges, burrs, or the like. In a constructed embodiment, the outside diameter of cup 37*a* in the region of the first side wall 76*a*, is approximately 11.20 mm, with an inside diameter of inner surface 81*a* of between about 9.2 and 9.3 mm. The second diameter at the radially outermost extent of second annular side wall 82*a*, is approximately between about 5.3–5.5 mm, in the constructed embodiment. Of course, variations may be made depending on the requirements of the ignition coil and still come within the spirit and scope of the present invention.

Figure 5:
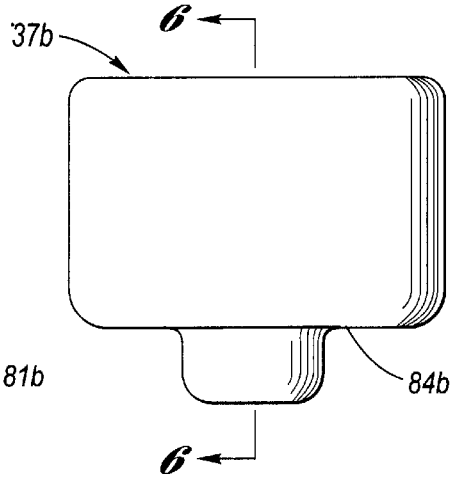
FIG. 5 is a simplified front view of a second embodiment of the cup of FIG. 2.
Figure 6:
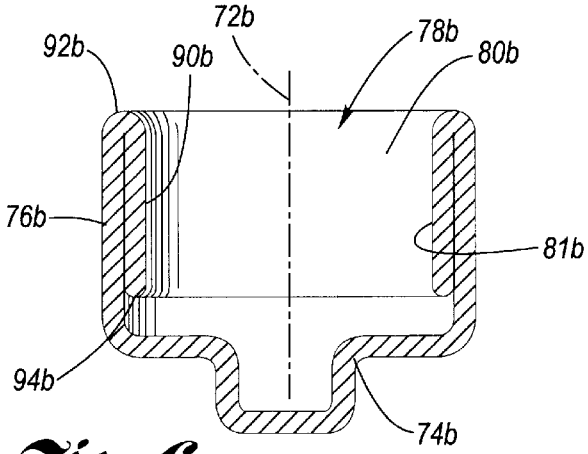
FIG. 6 is a simplified cross-sectional view of the second embodiment taken long lines 6—6 in FIG. 5.

FIGS. 5–6 show a second embodiment, designated cup 37*b*. Unless otherwise noted, cup 37*b* functions the same as cup 37*a*. Cup 37*b* also includes a base 74*b*, a first generally annular side wall 76*b*, an opening 78*b*, an interior 80*b* defined in part by an inner annular surface 8l*b*. Cup 37*b* includes a contact surface 84*b* for engaging a high voltage spring 68 or the like suitable for connecting to spark plug 14. Significantly, however, cup 37*b* is formed out of stamped sheet metal, which is subjected to a drawing and forming operation to arrive at the result shown in FIGS. 5–6. The approach in making cup 37*b* is substantially reduced in cost relative to the machining operation used to produce the cup 37*a* shown in FIGS. 3–4. Cup 37*b* includes another annular side wall 90*b* extending from the first annular side all 76*b* via a fold region 92*b*. A free end 94*b* of cup 37*b* has been folded inwardly so as to be contained in interior 80*b*. Fold 92*b* exhibits a relatively large radii, so as to maintain a reduced electric field (i.e., eliminate sharp edges). Cup 37*b* may be formed out of aluminum, brass, or other suitable electrically conductive material.

Figure 7:
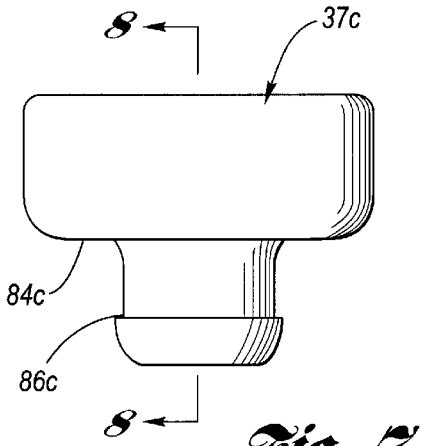
FIG. 7 is a simplified front view of a third embodiment of the cup of FIG. 2.
Figure 8:
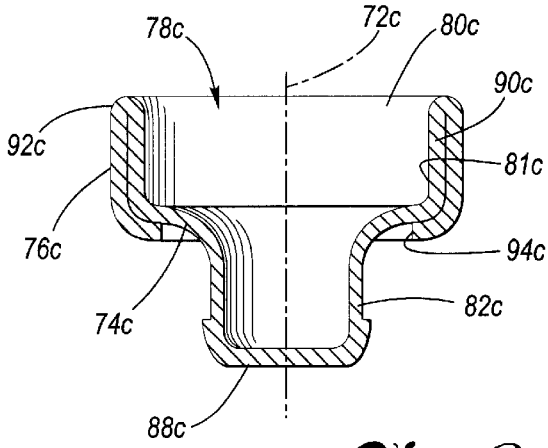
FIG. 8 is a simplified cross-sectional view of the third embodiment taken substantially along lines 8—8 in FIG. 7.

FIGS. 7–8 show a third embodiment, designated cup 37*c*. Unless otherwise noted, the functional and structural relationships between the relative features of cup 37*c* are the same as either of cups 37*a*, and 37*b*. Cup 37*c* is similar in size and shape to cup 37*a*, but is formed according to stamping, drawing and forming operations. Cup 37*c* includes a longitudinal axis 72*c*, a base 74*c*, a first annular side wall 76*c*, an opening 78*c*, an interior 80*c*, an inner, annular surface 81*c*, a second annular side wall 82*c*, surfaces 84*c* and 86*c*, closed end 88*c*, a third annular side wall 90*c*, a fold region 92*c*, and a free end 94*c*. Note, that the free end 94 of the annular side wall is folded so as to be on the outside of cup 37*c*. Again, cup 37*c* may be formed out of aluminum, brass, or other suitable electrically conductive material. Cup 37*c* is markedly less expensive to make than cup 37*a*. In one configuration, a volume unit cost for cup 37*a* was approximately six times the volume unit cost for cup 37*c*.

FIG. 9 shows a simplified chart of the reduced electric field resulting in an ignition apparatus according to the invention that includes cup 37. In particular, the electric field for the improved ignition apparatus 10 is shown in trace 94, while the electric field of a conventional arrangement is shown in trace 96. The illustrated traces 94, and 96 correspond to an approximately 72% reduction in the electric field intensity.

Referring again to FIG. 1, further details concerning ignition apparatus 10 will now be set forth configured to enable one to practice the present invention. It should be understood that portions of the following are exemplary only and not limiting in nature. Many other configurations are known to those of ordinary skill in the art and are consistent with the teachings of the present invention. Core 16 may be elongated, having a main, longitudinal axis "A" associated therewith. Core 16 includes an upper, first end 42, and a lower, second end 44. Core 16 may be a conventional core known to those of ordinary skill in the art. As illustrated, core 16, in the preferred embodiment, takes a generally cylindrical shape (which is a generally circular shape in radial cross-section), and may comprise compression molded insulated iron particles or laminated steel plates, both as known.

Magnets 18 and 20 may be included in ignition apparatus 10 as part of the magnetic circuit, and provide a magnetic bias for improved performance. The construction of magnets such as magnets 18 and 20, as well as their use and effect on performance, is well understood by those of ordinary skill in the art. It should be understood that magnets 18 and 20 are optional in ignition apparatus 10, and may be omitted, albeit with a reduced level of performance, which may be acceptable, depending on performance requirements. A rubber buffer cup 46 may be included.

Primary winding 24 may be wound directly onto core 16 in a manner known in the art. Primary winding 24 includes first and second ends and is configured to carry a primary current $I_P$ for charging apparatus 10 upon control of ignition system 12. Winding 24 may be implemented using known approaches and conventional materials. Although not shown, primary winding 24 may be wound on a primary winding spool (not shown) in certain circumstances (e.g., when steel laminations are used).

Layers 26 and 32 comprise an encapsulant suitable for providing electrical insulation within ignition apparatus 10.

In a preferred embodiment, the encapsulant comprises epoxy potting material. The epoxy potting material introduced in layers 26, and 32 may be introduced into annular potting channels defined (i) between primary winding 24 and secondary winding spool 28, and, (ii) between secondary winding 30 and case 34. The potting channels are filled with potting material, in the illustrated embodiment, up to approximately the level designated "L" in FIG. 1. In one embodiment, layer 26 may be between about 0.1 mm and 1.0 mm thick. Of course, a variety of other thicknesses are possible depending on flow characteristics and insulating characteristics of the encapsulant and the design of the coil 10. The potting material also provides protection from environmental factors which may be encountered during the service life of ignition apparatus 10. There is a number of suitable epoxy potting materials well known to those of ordinary skill in the art.

Secondary winding spool 28 is configured to receive and retain secondary winding 30. In addition to the features described above, spool 28 is further characterized as follows. Spool 28 is disposed adjacent to and radially outwardly of the central components comprising core 16, primary winding 24, and epoxy potting layer 26, and, preferably, is in coaxial relationship therewith. Spool 28 may comprise any one of a number of conventional spool configurations known to those of ordinary skill in the art. In the illustrated embodiment, spool 28 is configured to receive one continuous secondary winding (e.g., progressive winding) on an outer surface thereof, as is known. However, it should be understood that other configurations may be employed, such as, for example only, a configuration adapted for use with a segmented winding strategy (e.g., a spool of the type having a plurality of axially spaced ribs forming a plurality of channels therebetween for accepting windings) as known.

The depth of the secondary winding in the illustrated embodiment may decrease from the top of spool 28 (i.e., near the upper end 42 of core 16), to the other end of spool 28 (i.e., near the lower end 44) by way of a progressive gradual flare of the spool body. The result of the flare or taper is to increase the radial distance (i.e., taken with respect to axis "A") between primary winding 24 and secondary winding 30, progressively, from the top to the bottom. As is known in the art, the voltage gradient in the axial direction, which increases toward the spark plug end (i.e., high voltage end) of the secondary winding, may require increased dielectric insulation between the secondary and primary windings, and, may be provided for by way of the progressively increased separation between the secondary and primary windings.

Spool 28 is formed generally of electrical insulating material having properties suitable for use in a relatively high temperature environment. For example, spool 28 may comprise plastic material such as PPO/PS (e.g., NORYL available from General Electric) or polybutylene terephthalate (PBT) thermoplastic polyester. It should be understood that there are a variety of alternative materials that may be used for spool 28 known to those of ordinary skill in the ignition art, the foregoing being exemplary only and not limiting in nature.

Spool 28 may further include a first and second annular feature 48 and 50 formed at axially opposite ends thereof. Features 48 and 50 may be configured so as to engage an inner surface of case 34 to locate, align, and center the spool 28 in the cavity of case 34.

As described above, spool 28 includes an electrically conductive (i.e., metal) high-voltage (HV) terminal 52 disposed therein configured to engage cup 37, which in turn is electrically connected to the HV connector assembly 40. The body of spool 28 at a lower end thereof is configured so as to be press-fit into the interior of cup 37 (i.e., the spool gate portion).

FIG. 1 also shows secondary winding 30 in cross-section. Secondary winding 30, as described above, is wound on spool 28, and includes a low voltage end and a high voltage end. The low voltage end may be connected to ground by way of a ground connection through LV connector body 38 in a manner known to those of ordinary skill in the art. The high voltage end is connected to HV terminal 52. Winding 30 may be implemented using conventional approaches and material known to those of ordinary skill in the art.

Case 34 includes an inner, generally enlarged cylindrical surface, an outer surface, a first annular shoulder, a flange, an upper through-bore, and a lower through bore.

The inner surface of case 34 is configured in size to receive and retain spool 28 which contains the core 16 and primary winding 24. The inner surface of case 34 may be slightly spaced from spool 28, particularly the annular spacing features 48, 50 thereof (as shown), or may engage the spacing features 48, 50.

Lower through bore 64 (best shown in FIG. 2) is defined by an inner surface thereof configured in size and shape (i.e., generally cylindrical) to provide a press fit with an outer surface of cup 37 at a lowermost portion thereof as described above. When the lowermost body portion of spool 28 is inserted in the lower bore containing cup 37, HV terminal 52 engages an inner surface of cup 37 (also via a press fit).

Case 34 is formed of electrical insulating material, and may comprise conventional materials known to those of ordinary skill in the art (e.g., the PBT thermoplastic polyester material referred to above).

Shield 36 is generally annular in shape and is disposed radially outwardly of case 34, and, preferably, engages an outer surface of case 34. The shield 36 preferably comprises electrically conductive material, and, more preferably metal, such as silicon steel or other adequate magnetic material. Shield 36 provides not only a protective barrier for ignition apparatus 10 generally, but, further, provides a magnetic path for the magnetic circuit portion of ignition apparatus 10. Shield 36 may nominally be about 0.50 mm thick, in one embodiment. Shield 36 may be grounded by way of an internal grounding strap, finger or the like (not shown) well know to those of ordinary skill in the art. Shield 36 may comprise multiple, individual sheets 36, as shown.

Low voltage connector body 38 is configured to, among other things, electrically connect the first and second ends of primary winding 24 to an energization source, such as, the energization circuitry included in ignition system 12. Connector body 38 is generally formed of electrical insulating material, but also includes a plurality of electrically conductive output terminals 66 (e.g., pins for ground, primary winding leads, etc.). Terminals 66 are coupled electrically, internally through connector body 38, in a manner known to those of ordinary skill in the art, and are thereafter connected to various parts of apparatus 10, also in a manner generally know to those of ordinary skill in the art.

HV connector assembly 40 may include a spring contact 68 or the like, which is electrically coupled to cup 37. Contact spring 68 is in turn configured to engage a high-voltage connector terminal of spark plug 14. This arrangement for coupling the high voltage developed by secondary winding 30 to plug 14 is exemplary only; a number of alternative connector arrangements, particularly spring-biased arrangements, are known in the art.

An ignition apparatus in accordance with the present in invention includes a conductive cup used in establishing a high voltage connection between the secondary winding/HV terminal and the spark plug (via spring 68) which significantly reduces the electric field intensity in the area of the connection. The reduction in the electric field intensity substantially minimizes or eliminates a significant failure mode for pencil ignition coils, namely, grounding out of the secondary winding through an arcing via a dendrite form in the insulating material (e.g., to a ground (i.e., outer core or shield)). This reduction of the failure mode leads to lower warranty returns due to substantially reducing or eliminating such failure, as well as increasing the products expected service life. In addition, the invention provides manufacturing advantages, namely, a more robust design respecting solder tips and sharp edges. In addition, the inventive configuration will also be robust to the bend position of the high voltage terminal 52, particularly projection 58 thereof, so that the position will not have to be as tightly controlled. The invention also provides cost advantages, in particular, eliminating the need for manufacturing equipment to eliminate or remove sharp solder points, as well as eliminating equipment required to measure the high voltage terminal bent position.

What is claimed is:

1. An ignition coil comprising:

a central core having a main axis;

a primary winding;

a spool having a high-voltage terminal;

a secondary winding wound on said spool and having a high-voltage end connected to said terminal;

a case outwardly of said core, said spool and said primary and secondary windings; and a cup formed of metal material engaging said terminal and configured to be contacted by a conductive connector that is suitable for connection to a spark plug.

2. The coil of claim 1 wherein said cup includes a base, and a first generally annular side wall extending therefrom in a first direction to define an opening leading to an interior, said interior being configured to receive a corresponding feature formed on a distal end of said spool proximate said high-voltage terminal.

3. The coil of claim 2 wherein said corresponding feature comprises a spool gate.

4. The coil of claim 2 wherein said cup further includes a second annular side wall extending from said base in a second direction opposite said first direction, said base and an outer surface of said second annular wall forming an engagement arrangement for said conductive connector.

5. The coil of claim 4 wherein said cup is closed at an end opposite said opening.

6. The coil of claim 4 wherein said first annular wall has a first diameter associated therewith and said second annular wall has a second diameter associated therewith smaller than said first diameter.

7. The coil of claim 1 wherein said cup comprises one of aluminum and brass material, and steel.

8. The coil of claim 1 wherein said cup has a longitudinal axis associated therewith, said cup further comprising a third annular wall radially outwardly of said second annular wall and extending therefrom, a free end of said third annular wall being located outside said interior.

9. The coil of claim 1 wherein said cup has a longitudinal axis associated therewith, said cup further comprising a third annular wall radially outwardly of said second annular wall and extending therefrom, a free end of said third annular wall being located in said interior.

10. The coil of claim 8 wherein said cup is formed of stamped sheet metal, a fold region defined between said first and third annular walls being proximate said opening.

11. The coil of claim 1 wherein said high-voltage terminal includes a resilient arrangement configured for engaging an inner surface of said cup.

12. An ignition coil comprising:

a central core formed of magnetically permeable material having a main axis;

a primary winding disposed radially outwardly of said core;

a secondary winding spool having a high-voltage terminal;

a secondary winding wound on said spool and having a high-voltage end connected to said high-voltage terminal;

a case formed of electrical insulating material disposed outwardly of said core, said spool and said primary and secondary windings;

an outer core formed of magnetically permeable material located radially outwardly of said case; and a cup formed of metal contacting said high-voltage terminal and configured to be contacted by a conductive connector that is suitable for connection to a spark plug.

13. A method of making a high-voltage connection between an ignition coil having a secondary winding with a high-voltage end thereof connected to a high-voltage terminal and a high-voltage connector configured to be connected to a spark plug, said method comprising the step of interposing an electrically conductive cup between the high-voltage terminal and the connector to thereby reduce an electric field.

14. The method of claim 13 further including the steps of:

stamping a first pattern from sheet metal; and forming the first pattern of sheet metal into the cup.

15. The method of claim 14 further comprising the step of finishing the cup to remove artifacts selected from the group comprising sharp edges and defects.

16. The method of claim 13 further including the steps of:

forming the cup from a metal piece; and vibratory finishing the cup to remove artifacts selected from the group comprising sharp edges and burrs.

* * * * *